United States Patent [19]

Franceschina

[11] Patent Number: 4,984,444

[45] Date of Patent: Jan. 15, 1991

[54] METHOD OF REDUCING TUBULAR PRODUCTS

[76] Inventor: Louis E. Franceschina, Mervis Dr., Beaver Falls, Pa.

[21] Appl. No.: 343,347

[22] Filed: Apr. 26, 1989

[51] Int. Cl.[5] ..... B21B 39/08

[52] U.S. Cl. ..... 72/205; 72/14

[58] Field of Search ..... 72/208, 14, 205, 234, 72/365, 366

[56] References Cited

U.S. PATENT DOCUMENTS 4,382,376 5/1983 Brauer et al. ..... 72/205

FOREIGN PATENT DOCUMENTS 61-14010 1/1986 Japan ..... 72/208

1274698 5/1972 United Kingdom ..... 72/14

OTHER PUBLICATIONS

Peble, H. J., "Stretch-Reducing Mills—Modern Technology & Developments", in Tube & Pipe Technology (Jan./Feb. 1989), pp. 29–36.

*Primary Examiner*—Lowell A. Larson

*Assistant Examiner*—T. C. Schoeffler

*Attorney, Agent, or Firm*—Barrigar & Oyen

[57] ABSTRACT

A method of reducing tubular metal products includes the steps of selecting a tube to be reduced having the specified initial wall thickness necessary to produce the desired finished wall thickness, and reducing the tube by passing it through a succession of roll stands which reduce the end portions of the tube without applying tension between roll stands and which reduce the portion of the tube intermediate the end portions with application of tension. The method produces reduced tubular products with substantially uniform wall thickness throughout eliminating the necessity of cropping end portions which have out-of-specification wall thickness.

5 Claims, 13 Drawing Sheets

| SAMPLE #2 | WALL HIGH | WALL LOW | WALL AVG. |
|---|---|---|---|
| FRONT END | | | |
| 1F | 0.430 | 0.406 | 0.418 |
| 2F | 0.432 | 0.405 | 0.419 |
| 3F | 0.437 | 0.410 | 0.424 |
| 4F | 0.436 | 0.411 | 0.424 |
| 5F | 0.432 | 0.410 | 0.421 |
| 6F | 0.436 | 0.411 | 0.424 |
| 7F | 0.436 | 0.413 | 0.426 |
| 8F | 0.438 | 0.412 | 0.425 |
| 9F | 0.441 | 0.408 | 0.425 |
| 10F | 0.438 | 0.412 | 0.425 |
| 11F | 0.436 | 0.408 | 0.422 |
| 12F | 0.438 | 0.409 | 0.424 |
| CENTRE FE | 0.437 | 0.403 | 0.420 |
| AVG | 0.436 | 0.408 | 0.422 |
| AVG | 0.436 | 0.408 | 0.422 |
| CENTRE BE | 0.434 | 0.412 | 0.423 |
| 12B | 0.436 | 0.412 | 0.424 |
| 11B | 0.443 | 0.398 | 0.421 |
| 10B | 0.437 | 0.412 | 0.425 |
| 9B | 0.439 | 0.402 | 0.421 |
| 8B | 0.438 | 0.406 | 0.422 |
| 7B | 0.436 | 0.412 | 0.424 |
| 6B | 0.436 | 0.406 | 0.422 |
| 5B | 0.438 | 0.405 | 0.422 |
| 4B | 0.436 | 0.404 | 0.420 |
| 3B | 0.432 | 0.408 | 0.420 |
| 2B | 0.438 | 0.406 | 0.422 |
| 1B | 0.435 | 0.406 | 0.421 |

| SAMPLE #2 | .....WALL..... | | |
|---|---|---|---|
| | HIGH | LOW | AVG. |
| FRONT END | | | |
| 1F | 0.430 | 0.406 | 0.418 |
| 2F | 0.432 | 0.405 | 0.419 |
| 3F | 0.437 | 0.410 | 0.424 |
| 4F | 0.436 | 0.411 | 0.424 |
| 5F | 0.432 | 0.410 | 0.421 |
| 6F | 0.436 | 0.411 | 0.424 |
| 7F | 0.438 | 0.413 | 0.426 |
| 8F | 0.438 | 0.412 | 0.425 |
| 9F | 0.441 | 0.408 | 0.425 |
| 10F | 0.438 | 0.412 | 0.425 |
| 11F | 0.436 | 0.408 | 0.422 |
| 12F | 0.438 | 0.409 | 0.424 |
| CENTRE FE | 0.437 | 0.403 | 0.420 |
| AVG | 0.436 | 0.408 | 0.422 |
| AVG | 0.436 | 0.408 | 0.422 |
| CENTRE BE | 0.434 | 0.412 | 0.423 |
| 12B | 0.436 | 0.412 | 0.424 |
| 11B | 0.443 | 0.398 | 0.421 |
| 10B | 0.437 | 0.412 | 0.425 |
| 9B | 0.439 | 0.402 | 0.421 |
| 8B | 0.438 | 0.406 | 0.422 |
| 7B | 0.436 | 0.412 | 0.424 |
| 6B | 0.436 | 0.408 | 0.422 |
| 5B | 0.438 | 0.405 | 0.422 |
| 4B | 0.436 | 0.404 | 0.420 |
| 3B | 0.432 | 0.408 | 0.420 |
| 2B | 0.438 | 0.406 | 0.422 |
| 1B | 0.435 | 0.406 | 0.421 |

| SAMPLE #3 | .....WALL..... | | |
|---|---|---|---|
| | HIGH | LOW | AVG. |
| FRONT END | | | |
| 1F | 0.438 | 0.417 | 0.428 |
| 2F | 0.435 | 0.409 | 0.422 |
| 3F | 0.438 | 0.415 | 0.427 |
| 4F | 0.442 | 0.407 | 0.425 |
| 5F | 0.440 | 0.411 | 0.426 |
| 6F | 0.439 | 0.406 | 0.423 |
| 7F | 0.442 | 0.408 | 0.425 |
| 8F | 0.434 | 0.412 | 0.423 |
| 9F | 0.436 | 0.413 | 0.425 |
| 10F | 0.440 | 0.406 | 0.423 |
| 11F | 0.438 | 0.406 | 0.422 |
| 12F | 0.436 | 0.410 | 0.423 |
| CENTRE FE | 0.436 | 0.412 | 0.424 |
| AVG | 0.436 | 0.412 | 0.424 |
| AVG | 0.436 | 0.412 | 0.424 |
| CENTRE BE | 0.435 | 0.412 | 0.424 |
| 12B | 0.437 | 0.412 | 0.425 |
| 11B | 0.438 | 0.418 | 0.428 |
| 10B | 0.438 | 0.415 | 0.427 |
| 9B | 0.442 | 0.410 | 0.426 |
| 8B | 0.438 | 0.412 | 0.425 |
| 7B | 0.437 | 0.416 | 0.427 |
| 6B | 0.442 | 0.404 | 0.423 |
| 5B | 0.438 | 0.406 | 0.422 |
| 4B | 0.439 | 0.405 | 0.422 |
| 3B | 0.438 | 0.412 | 0.425 |
| 2B | 0.435 | 0.410 | 0.423 |
| 1B | 0.436 | 0.394 | 0.415 |

| SAMPLE #1 | .....WALL..... | | |
|---|---|---|---|
| 41'8" | HIGH | LOW | AVG. |
| FRONT END | | | |
| 1F | 0.460 | 0.438 | 0.449 |
| 2F | 0.456 | 0.434 | 0.445 |
| 3F | 0.466 | 0.436 | 0.451 |
| 4F | 0.440 | 0.406 | 0.423 |
| 5F | 0.429 | 0.406 | 0.418 |
| 6F | 0.427 | 0.415 | 0.421 |
| 7F | 0.436 | 0.406 | 0.421 |
| 8F | 0.429 | 0.394 | 0.412 |
| 9F | 0.425 | 0.392 | 0.409 |
| 10F | 0.421 | 0.401 | 0.411 |
| 11F | 0.415 | 0.403 | 0.409 |
| 12F | 0.428 | 0.397 | 0.413 |
| CENTRE FE | 0.420 | 0.390 | 0.405 |
| AVG | 0.420 | 0.393 | 0.407 |
| AVG | 0.420 | 0.393 | 0.407 |
| CENTRE BE | 0.420 | 0.396 | 0.408 |
| 12B | 0.416 | 0.392 | 0.404 |
| 11B | 0.423 | 0.391 | 0.407 |
| 10B | 0.419 | 0.398 | 0.409 |
| 9B | 0.421 | 0.402 | 0.412 |
| 8B | 0.0423 | 0.403 | 0.413 |
| 7B | 0.0427 | 0.406 | 0.417 |
| 6B | 0.0432 | 0.409 | 0.421 |
| 5B | 0.0438 | 0.416 | 0.427 |
| 4B | 0.0436 | 0.410 | 0.423 |
| 3B | 0.0452 | 0.425 | 0.439 |
| 2B | 0.0473 | 0.412 | 0.443 |
| 1B | 0.0483 | 0.444 | 0.464 |

PRIOR ART

| SAMPLE #2 41'6" FRONT END | WALL HIGH | WALL LOW | WALL AVG. |
|---|---|---|---|
| 1F | 0.470 | 0.440 | 0.455 |
| 2F | 0.462 | 0.428 | 0.445 |
| 3F | 0.458 | 0.438 | 0.448 |
| 4F | 0.435 | 0.417 | 0.426 |
| 5F | 0.433 | 0.413 | 0.423 |
| 6F | 0.438 | 0.408 | 0.423 |
| 7F | 0.423 | 0.401 | 0.412 |
| 8F | 0.429 | 0.406 | 0.418 |
| 9F | 0.430 | 0.395 | 0.413 |
| 10F | 0.429 | 0.396 | 0.413 |
| 11F | 0.424 | 0.402 | 0.413 |
| 12F | 0.418 | 0.403 | 0.411 |
| CENTRE FE | 0.426 | 0.396 | 0.411 |
| AVG | 0.429 | 0.393 | 0.411 |
| AVG | 0.429 | 0.393 | 0.411 |
| CENTRE BE | 0.431 | 0.390 | 0.411 |
| 12B | 0.412 | 0.399 | 0.406 |
| 11B | 0.416 | 0.394 | 0.405 |
| 10B | 0.420 | 0.394 | 0.407 |
| 9B | 0.426 | 0.396 | 0.411 |
| 8B | 0.421 | 0.402 | 0.412 |
| 7B | 0.420 | 0.408 | 0.414 |
| 6B | 0.423 | 0.412 | 0.418 |
| 5B | 0.436 | 0.415 | 0.426 |
| 4B | 0.438 | 0.412 | 0.425 |
| 3B | 0.457 | 0.430 | 0.444 |
| 2B | 0.475 | 0.440 | 0.458 |
| 1B | 0.469 | 0.441 | 0.455 |

PRIOR ART

| SAMPLE #6 | .....WALL..... | | |
|---|---|---|---|
| 39'3" | HIGH | LOW | AVG. |
| FRONT END | | | |
| 1F | 0.506 | 0.466 | 0.486 |
| 2F | 0.503 | 0.479 | 0.491 |
| 3F | 0.504 | 0.479 | 0.492 |
| 4F | 0.504 | 0.470 | 0.487 |
| 5F | 0.511 | 0.460 | 0.486 |
| 6F | 0.509 | 0.460 | 0.485 |
| 7F | 0.507 | 0.465 | 0.486 |
| 8F | 0.511 | 0.468 | 0.490 |
| 9F | 0.509 | 0.469 | 0.489 |
| 10F | 0.505 | 0.486 | 0.496 |
| 11F | 0.501 | 0.479 | 0.490 |
| 12F | 0.499 | 0.477 | 0.488 |
| CENTRE FE | 0.503 | 0.478 | 0.491 |
| AVG | 0.503 | 0.479 | 0.491 |
| AVG | 0.503 | 0.479 | 0.491 |
| CENTRE BE | 0.503 | 0.479 | 0.491 |
| 12B | 0.505 | 0.474 | 0.490 |
| 11B | 0.504 | 0.475 | 0.490 |
| 10B | 0.503 | 0.470 | 0.487 |
| 9B | 0.506 | 0.471 | 0.489 |
| 8B | 0.503 | 0.477 | 0.490 |
| 7B | 0.503 | 0.464 | 0.484 |
| 6B | 0.490 | 0.465 | 0.478 |
| 5B | 0.492 | 0.467 | 0.480 |
| 4B | 0.493 | 0.469 | 0.481 |
| 3B | 0.492 | 0.468 | 0.480 |
| 2B | 0.491 | 0.470 | 0.481 |
| 1B | 0.505 | 0.452 | 0.479 |

| SAMPLE #9 | .....WALL..... | | |
|---|---|---|---|
| 39'10" | HIGH | LOW | AVG. |
| FRONT END | | | |
| 1F | 0.499 | 0.478 | 0.489 |
| 2F | 0.507 | 0.481 | 0.494 |
| 3F | 0.502 | 0.478 | 0.490 |
| 4F | 0.496 | 0.480 | 0.488 |
| 5F | 0.495 | 0.478 | 0.487 |
| 6F | 0.495 | 0.479 | 0.487 |
| 7F | 0.497 | 0.479 | 0.488 |
| 8F | 0.498 | 0.473 | 0.486 |
| 9F | 0.504 | 0.480 | 0.492 |
| 10F | 0.512 | 0.478 | 0.495 |
| 11F | 0.512 | 0.474 | 0.493 |
| 12F | 0.503 | 0.475 | 0.489 |
| CENTRE FE | 0.498 | 0.470 | 0.484 |
| AVG | 0.497 | 0.474 | 0.485 |
| AVG | 0.497 | 0.474 | 0.485 |
| CENTRE BE | 0.495 | 0.478 | 0.487 |
| 12B | 0.495 | 0.479 | 0.487 |
| 11B | 0.500 | 0.479 | 0.490 |
| 10B | 0.502 | 0.477 | 0.490 |
| 9B | 0.500 | 0.480 | 0.490 |
| 8B | 0.503 | 0.474 | 0.489 |
| 7B | 0.499 | 0.482 | 0.491 |
| 6B | 0.502 | 0.478 | 0.490 |
| 5B | 0.507 | 0.485 | 0.496 |
| 4B | 0.503 | 0.486 | 0.495 |
| 3B | 0.506 | 0.486 | 0.496 |
| 2B | 0.510 | 0.486 | 0.498 |
| 1B | 0.506 | 0.484 | 0.495 |

| SAMPLE #13 40'4" FRONT END | WALL HIGH | WALL LOW | WALL AVG. |
|---|---|---|---|
| 1F | 0.503 | 0.486 | 0.495 |
| 2F | 0.503 | 0.465 | 0.484 |
| 3F | 0.487 | 0.461 | 0.474 |
| 4F | 0.490 | 0.469 | 0.480 |
| 5F | 0.482 | 0.464 | 0.473 |
| 6F | 0.489 | 0.455 | 0.472 |
| 7F | 0.492 | 0.456 | 0.474 |
| 8F | 0.490 | 0.465 | 0.478 |
| 9F | 0.500 | 0.465 | 0.483 |
| 10F | 0.492 | 0.461 | 0.477 |
| 11F | 0.487 | 0.463 | 0.475 |
| 12F | 0.489 | 0.466 | 0.478 |
| CENTRE FE | 0.487 | 0.467 | 0.477 |
| AVG | 0.484 | 0.465 | 0.474 |
| AVG | 0.484 | 0.465 | 0.474 |
| CENTRE BE | 0.480 | 0.462 | 0.471 |
| 12B | 0.487 | 0.471 | 0.479 |
| 11B | 0.485 | 0.470 | 0.478 |
| 10B | 0.495 | 0.475 | 0.485 |
| 9B | 0.489 | 0.467 | 0.478 |
| 8B | 0.487 | 0.470 | 0.479 |
| 7B | 0.484 | 0.466 | 0.475 |
| 6B | 0.489 | 0.474 | 0.482 |
| 5B | 0.497 | 0.478 | 0.488 |
| 4B | 0.505 | 0.478 | 0.492 |
| 3B | 0.501 | 0.475 | 0.488 |
| 2B | 0.502 | 0.471 | 0.487 |
| 1B | 0.516 | 0.500 | 0.508 |

PRIOR ART

| SAMPLE #12 40'6" FRONT END | WALL HIGH | WALL LOW | WALL AVG. |
|---|---|---|---|
| 1F | 0.509 | 0.489 | 0.499 |
| 2F | 0.503 | 0.487 | 0.495 |
| 3F | 0.503 | 0.484 | 0.494 |
| 4F | 0.496 | 0.475 | 0.486 |
| 5F | 0.496 | 0.477 | 0.487 |
| 6F | 0.502 | 0.472 | 0.487 |
| 7F | 0.486 | 0.467 | 0.477 |
| 8F | 0.497 | 0.477 | 0.487 |
| 9F | 0.497 | 0.470 | 0.484 |
| 10F | 0.506 | 0.481 | 0.494 |
| 11F | 0.497 | 0.470 | 0.484 |
| 12F | 0.489 | 0.473 | 0.481 |
| CENTRE FE | 0.484 | 0.474 | 0.479 |
| AVG | 0.486 | 0.476 | 0.481 |
| AVG | 0.486 | 0.476 | 0.481 |
| CENTRE BE | 0.488 | 0.477 | 0.483 |
| 12B | 0.495 | 0.477 | 0.486 |
| 11B | 0.498 | 0.477 | 0.488 |
| 10B | 0.485 | 0.472 | 0.479 |
| 9B | 0.488 | 0.474 | 0.481 |
| 8B | 0.492 | 0.473 | 0.483 |
| 7B | 0.498 | 0.474 | 0.486 |
| 6B | 0.494 | 0.470 | 0.482 |
| 5B | 0.501 | 0.481 | 0.491 |
| 4B | 0.503 | 0.486 | 0.495 |
| 3B | 0.499 | 0.483 | 0.491 |
| 2B | 0.506 | 0.498 | 0.502 |
| 1B | 0.507 | 0.492 | 0.500 |

PRIOR ART

| SAMPLE #14 | WALL | | |
|---|---|---|---|
| | HIGH | LOW | AVG. |
| FRONT END | | | |
| 1F | 0.420 | 0.402 | 0.411 |
| 2F | 0.419 | 0.397 | 0.408 |
| 3F | 0.416 | 0.392 | 0.404 |
| 4F | 0.403 | 0.383 | 0.393 |
| 5F | 0.391 | 0.374 | 0.383 |
| 6F | 0.387 | 0.371 | 0.379 |
| 7F | 0.380 | 0.367 | 0.374 |
| 8F | 0.379 | 0.356 | 0.368 |
| 9F | 0.375 | 0.350 | 0.363 |
| 10F | 0.371 | 0.353 | 0.362 |
| 11F | 0.368 | 0.356 | 0.362 |
| CENTRE FE | 0.364 | 0.354 | 0.359 |
| AVG | 0.364 | 0.355 | 0.359 |
| AVG | 0.364 | 0.355 | 0.359 |
| CENTRE BE | 0.363 | 0.355 | 0.359 |
| 11B | 0.373 | 0.363 | 0.368 |
| 10B | 0.379 | 0.368 | 0.374 |
| 9B | 0.383 | 0.370 | 0.377 |
| 8B | 0.387 | 0.372 | 0.380 |
| 7B | 0.390 | 0.372 | 0.381 |
| 6B | 0.397 | 0.374 | 0.386 |
| 5B | 0.415 | 0.375 | 0.395 |
| 4B | 0.413 | 0.382 | 0.398 |
| 3B | 0.415 | 0.390 | 0.403 |
| 2B | 0.423 | 0.412 | 0.418 |
| 1B | 0.435 | 0.423 | 0.429 |

PRIOR ART

| SAMPLE #6 | WALL | | | |
|---|---|---|---|---|
| | HIGH | LOW | AVG. | |
| FRONT END | | | | |
| 1F | 0.375 | 0.351 | 0.363 | |
| 2F | 0.381 | 0.347 | 0.364 | |
| 3F | 0.358 | 0.334 | 0.346 | |
| 4F | 0.363 | 0.339 | 0.351 | |
| 5F | 0.358 | 0.341 | 0.350 | |
| 6F | 0.357 | 0.336 | 0.347 | |
| 7F | 0.357 | 0.333 | 0.345 | |
| 8F | 0.353 | 0.333 | 0.343 | |
| 9F | 0.358 | 0.339 | 0.349 | |
| 10F | 0.352 | 0.336 | 0.344 | |
| 11F | 0.356 | 0.337 | 0.347 | |
| 12F | 0.357 | 0.335 | 0.346 | |
| CENTRE FE | 0.355 | 0.335 | 0.345 | |
| AVG | 0.353 | 0.335 | 0.344 | |
| AVG | 0.353 | 0.335 | 0.344 | |
| CENTRE BE | 0.351 | 0.335 | 0.343 | |
| 12B | 0.356 | 0.329 | 0.343 | PRIOR ART |
| 11B | 0.360 | 0.329 | 0.345 | |
| 10B | 0.361 | 0.328 | 0.345 | |
| 9B | 0.355 | 0.335 | 0.345 | |
| 8B | 0.351 | 0.339 | 0.345 | |
| 7B | 0.354 | 0.339 | 0.347 | |
| 6B | 0.357 | 0.337 | 0.347 | |
| 5B | 0.357 | 0.337 | 0.347 | |
| 4B | 0.362 | 0.338 | 0.350 | |
| 3B | 0.374 | 0.336 | 0.355 | |
| 2B | 0.361 | 0.334 | 0.348 | |
| 1B | 0.378 | 0.352 | 0.365 | |

| SAMPLE #5 | .....WALL..... | | |
|---|---|---|---|
| | HIGH | LOW | AVG. |
| FRONT END | | | |
| 1F | 0.367 | 0.353 | 0.360 |
| 2F | 0.363 | 0.353 | 0.358 |
| 3F | 0.363 | 0.351 | 0.357 |
| 4F | 0.361 | 0.345 | 0.353 |
| 5F | 0.359 | 0.349 | 0.354 |
| 6F | 0.356 | 0.348 | 0.352 |
| 7F | 0.361 | 0.347 | 0.354 |
| 8F | 0.360 | 0.345 | 0.353 |
| 9F | 0.362 | 0.344 | 0.353 |
| 10F | 0.356 | 0.346 | 0.351 |
| 11F | 0.361 | 0.350 | 0.356 |
| 12F | 0.358 | 0.349 | 0.354 |
| CENTRE FE | 0.369 | 0.350 | 0.360 |
| AVG | 0.363 | 0.350 | 0.356 |
| AVG | 0.363 | 0.350 | 0.356 |
| CENTRE BE | 0.357 | 0.349 | 0.353 |
| 12B | 0.356 | 0.349 | 0.353 |
| 11B | 0.360 | 0.349 | 0.355 |
| 10B | 0.363 | 0.346 | 0.355 |
| 9B | 0.369 | 0.346 | 0.358 |
| 8B | 0.368 | 0.345 | 0.357 |
| 7B | 0.366 | 0.343 | 0.355 |
| 6B | 0.362 | 0.347 | 0.355 |
| 5B | 0.368 | 0.340 | 0.354 |
| 4B | 0.379 | 0.346 | 0.363 |
| 3B | 0.376 | 0.335 | 0.356 |
| 2B | 0.365 | 0.348 | 0.357 |
| 1B | 0.370 | 0.347 | 0.359 |

METHOD OF REDUCING TUBULAR PRODUCTS

BACKGROUND OF THE INVENTION

Hot reducing refers to a process by which a steel tube (or pipe) of given diameter is reduced to a tube of smaller diameter by passing through a continuous series of roll stands, usually of two or three rolls per stand, each roll set having smaller nominal diameter than the preceding stand, without internal support to the tube and with the tube being reduced, having been preheated to an elevated temperature. As the outside and inside diameters of the tube are reduced, the tube length is elongated an amount related to the overall difference between entering and exiting cross sectional areas. To permit proper material flow, each successive roll stand rotates at higher speed than its preceding stand since each stand must accept and process in a given period of time a longer length of material than its predecessor. It is the relationship and control of these successive roll stand speeds that is the subject of this invention.

In the early days of tube and pipemaking, these roll stand speeds were designed to match the elongation of tube length based on the diameter reduction of each stand. In other words, the speed of each successive stand was increased only enough to match the surface speed of the roll to the surface speed of the tube or pipe passing through it. It was soon found that in this type of design, and due to the radial forces imposed on the tube to cause it to reduce, part of the material flow was radial instead of entirely longitudinal. The inside diameter was reduced more than the outside diameter, thereby causing the tube or pipe wall thickness to increase as diameter reduction progressed. This wall increasing phenomena limited the scope of application of the process because the wall thickness increased as the overall (outside) diameter reduction increased. The resulting effect was that with large reductions of outside diameters, the circular shape of the inside diameter was distorted due to non-uniform radial forces around the tube section caused by non-uniform rolling forces applied across the grooves of an essentially round pass formed by two or three rolls. Theoretically, only with an infinite number of rolls forming the pass would rolling forces be applied uniformly around the tube section. As a result, with large diameter reductions and particularly with heavier entering wall thicknesses, the inside diameter was distorted to a square shape in the case of two-roll mills and to a hexagonal shape in three-roll mills.

To overcome these shape problems and to extend the working range of the reducing process, mill designers began to calculate and design roll speeds of successive stands to be slightly higher than those required to match tube surface speed with roll surface speed at the normal roll groove pitch line diameter, in an attempt to develop a slight tension between stands so as to cause a greater portion of tube area reduction to move longitudinally into elongation and a smaller portion to move radially into wall thickness increase. This speed increase above normal or "overspeed" did not cause rolls to slip on the tube surface but merely caused the roll groove pitch line, or neutral point, to adjust to a new position of pitch diameter which again matched tube surface speed This practice worked well for the particular tube section for which it was designed, but the amount of tension required between stands varies with the amount of cross sectional area reduction. In those early days, reducing mills were usually driven by lineshafts from a single motor and the individual roll stand speed increase was effected through fixed gearing from the lineshaft to the roll stand. The speed increase between stands was therefore fixed and had to be calculated as a compromise over the total product range, again limiting the extremes to which the process could be applied.

It obviously became necessary to design speed control systems whereby the tension developed in the tube between stands could be varied depending on the tube section being processed. Individually driven roll stands, each with its own electric drive motor, provided the flexibility for such control. Initially, each stand drive motor had its own speed control and speeds were manually set to achieve a calculated speed increase curve. Today, these drives are computer controlled to accurately maintain speed regulation to preset speed curves calculated for each individual tube section being processed. Hydraulic and mechanical differential drives have been developed to accomplish the same result. These mills came to be known as stretch reducing mills because of the high tension forces they are capable of developing in the tube between roll stands.

In the modern stretch reducing mill, sufficient interstand tension can be developed to not only eliminate the natural tendency of tube wall thickness to increase, but to cause the wall thickness to decrease, resulting in even greater elongation than outer diameter reduction alone would provide.

One serious disadvantage of the stretch reducing process was found to be that this interstand tension could not be fully developed until several stands of the mill were in contact with the tube or pipe to provide sufficient grip or traction to maintain the desired tension. Therefore the tube ends were not subjected to the same tension as the intermediate tube body. As a result, both the front end of the tube entering the mill and the back end exiting the mill reacted in the same manner as the early reducing mills, with the wall thickness increasing until sufficient tension was generated to reduce the thickness of the main portion of the tube. This end effect was great enough to cause the end portions to be out of tolerance for heavy wall thickness over a considerable length of the tube. The difference between end and body wall thickness is related to the amount of tension or stretch necessary to produce the desired body wall thickness. A disadvantage is that sufficient tension is required to maintain entering wall thickness, without decreasing or increasing it, such that out-of-tolerance end thickness is necessarily produced. This disadvantage of stretch reducing rendered the process useless to those manufacturers who could supply only short lengths of tube or pipe to the stretch reducing mill. It was not uncommon for the out-of-tolerance lengths, or crop ends, to be ten to fifteen feet long at each end when area reductions were high. Obviously, if entering material was limited to 40 to 50 feet of length, the resulting yield losses could not be tolerated.

In an effort to reduce this end effect, various systems of crop end control were developed. Some of these systems are very complex and expensive, particularly in the case of the individual electric drive mills. The principle of operation of each of the various forms of crop end control is the same. A speed change is made from the normal speed curve as the tube ends are entering or leaving the mill. The intent of the speed change is to increase the speed differential between roll stands as the ends are being processed and to return to the normal speed curve for the main portion or body of the tube. By increasing the speed differential, tension in the tube ends is built up more quickly to attempt to reduce the length of out-of-tolerance product. Each of the various crop end control systems has proven to be only partially effective. The length of crop ends has been somewhat reduced, but none has eliminated the problem completely. A negative effect of present systems is that as the tube ends progress through the mill with increased speed differential, the portions of the tube body adjacent to the ends is also subject to increased tension during the time the roll stand speeds are adjusted back to normal. The wall thickness of these portions is thereby reduced more than desired with the possibility that those portions can be out-of-tolerance for light wall thickness.

SUMMARY OF THE INVENTION

The approach that I have taken to solve this problem, which is the subject of this patent application, is that if the end portions of the tube or pipe are processed without tension, the wall thickness of these ends will increase a predictable amount since no additionally imposed forces other than pure reduction are acting upon them. It is known from experience that if the entire length of tube or pipe is processed without tension, the effect on the wall thickness is just opposite that of stretch reducing, that is the wall thickness of the body sections will increase more than that of the end sections and the tube or pipe end lengths, or crop ends, will be out of tolerance for light wall thickness. It is also known from stretch reducing experience that tube or pipe body wall thickness can be maintained constant or reduced with increased tension, or allowed to increase with reduced tension. By utilizing both processes of pure reducing and stretch reducing, it remains only to control the individual roll stand speeds, and consequently the tension between roll stands, in such a manner as to allow the tube or pipe end portions to increase in wall thickness by pure reducing and to restrict the wall thickness increase in the tube or pipe body to the same amount to produce a tube or pipe of uniform wall thickness from end to end.

I have been able to accomplish such control. I have developed calculations of wall thickness changes for tube or pipe subjected to hot reducing of diameter have been developed for main body portions of length and both end portions (front end and back end lengths react differently) and have verified these calculations by actual production trials. Charts of tubes produced by this method and comparison charts of the same tube sizes produced by stretch reducing with crop end control are attached and form part of this specification.

The invention is directed to a method or process of rolling speed control for a stretch reducing mill for steel tubes, by which tube can be produced with substantially uniform wall thickness over its full length. The method is applicable to tube or pipe produced by either seamless or welded processes, in a variety of materials either ferrous or non-ferrous. The method can be applied to existing stretch reducing mills whether equipped with individual electric drives or hydraulic or mechanical differential drives without major changes to equipment or control systems. The method includes formulae for calculation of rolling speeds, calculation of proper entering tube or pipe dimensions for production of finished tube or pipe of required dimensions and setup parameters for stretch reducing mill operation.

BRIEF DESCRIPTION OF THE DRAWINGS

FIGS. 5 and 6 relate to tubes reduced by my inventive method.

FIGS. 7 and 8 relate to tubes reduced by standard methods.

Figure 12:
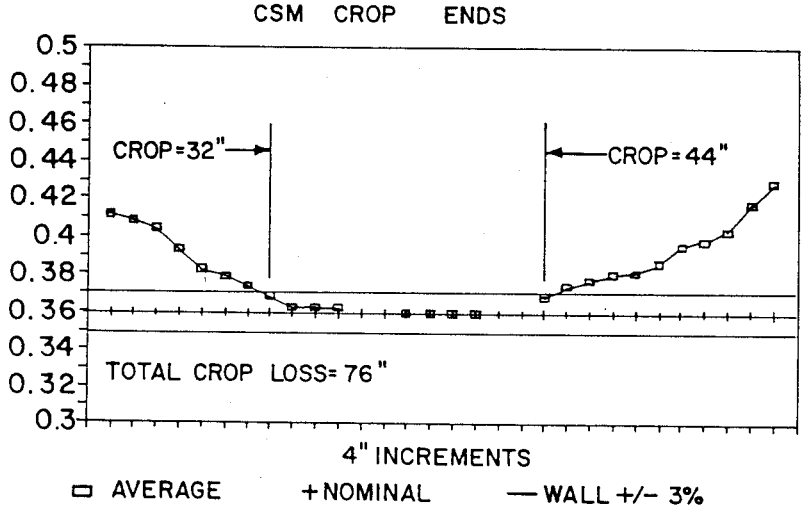
FIGS. 12 through 14 are combined charts and graphs relating to the reduction of three tubes of approximately the same wall thickness and subjected to approximately the same amount of outside diameter reduction, but produced by three different methods.

The tube to which FIG. 12 relates was rolled without crop end control.

Figure 13:
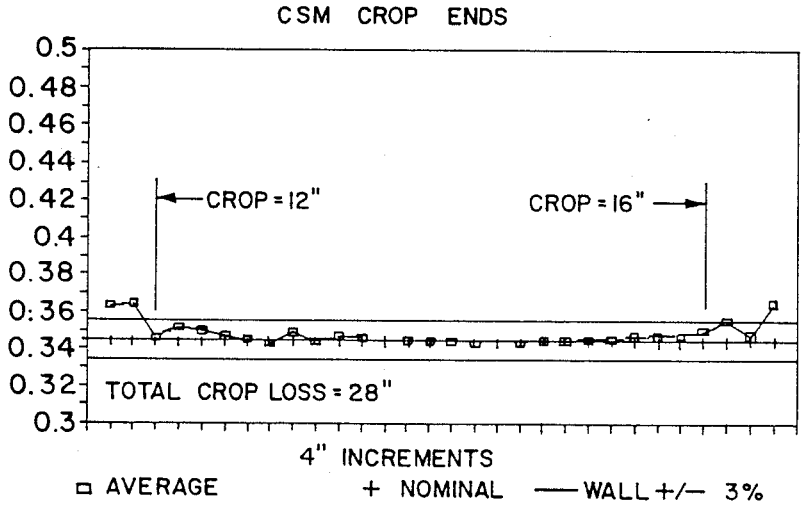

The FIG. 13 tube was rolled using standard overspeed and crop end control.

Figure 14:
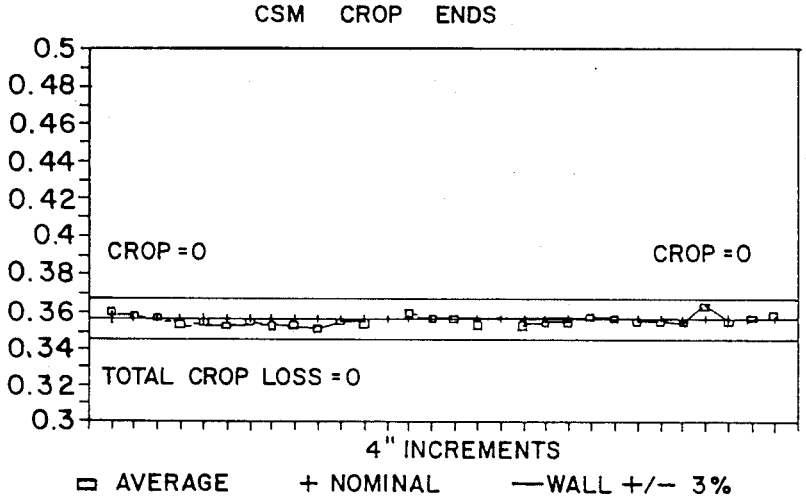

The FIG. 14 tube was produced according to my inventive method of overspeed and crop end control.

DETAILED DESCRIPTION OF THE INVENTION WITH REFERENCE TO THE DRAWINGS

To describe the process control according to my invention in greater detail, this control combines the use of the two processes of pure reducing (without tension between mill stands) and stretch reducing (with tension between mill stands).

Figure 1:
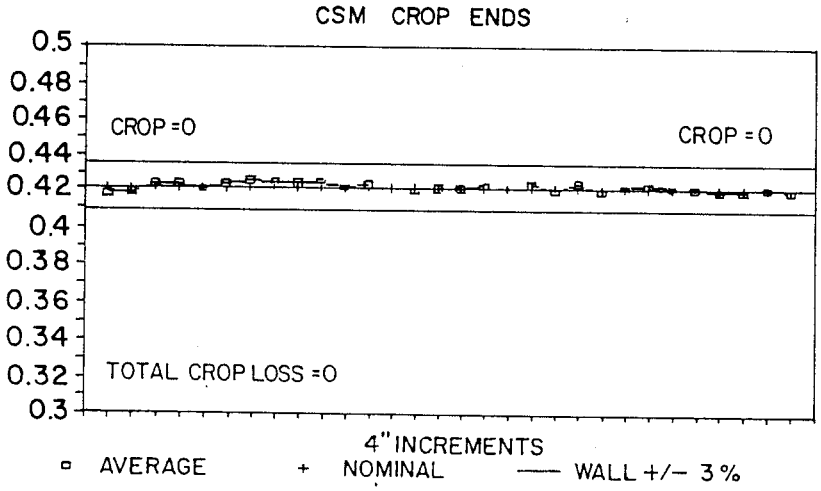
FIGS. 1 and 2 are combined charts and graphs for the production of tubes 2.5" outside diameter reduced from shells of 4.25" outside diameter according to the invention.
Figure 2:
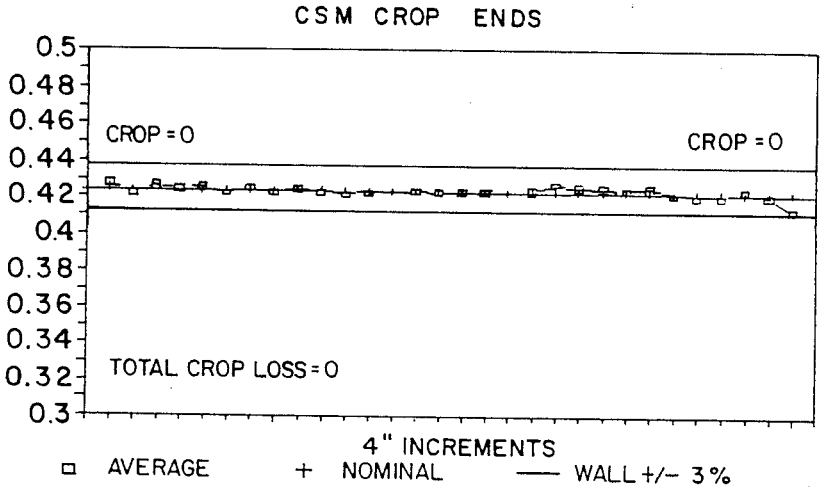
Figure 3:
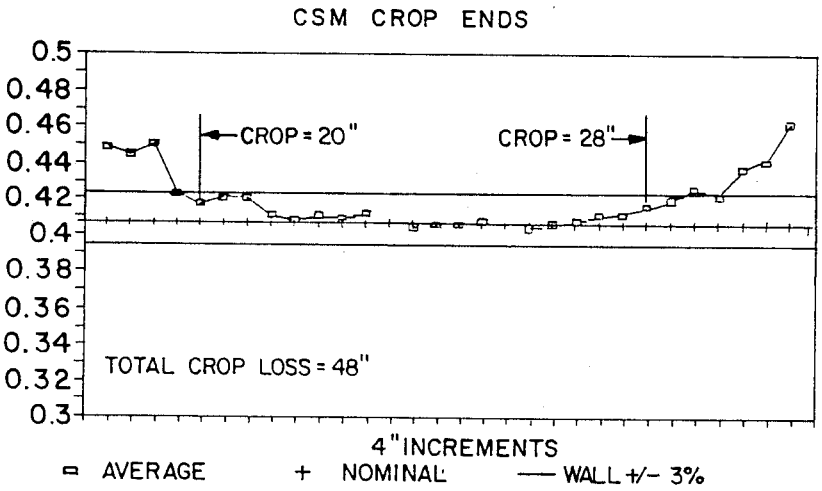
FIGS. 3 and 4 are combined charts and graphs for the production of the same size tubes from the same initial shells by standard stretch reducing method using normal crop end control.
Figure 4:
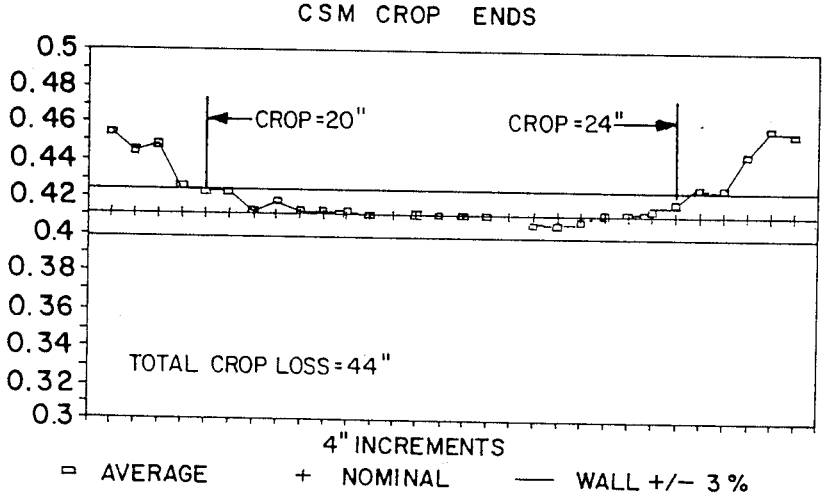
Figure 5:
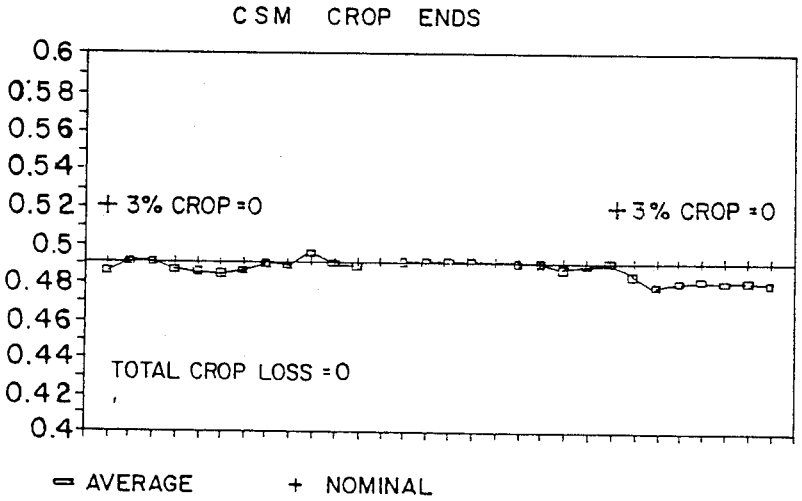
FIGS. 5 through 8 are comparable to FIGS. 1 through 4, being combined charts and graphs for the production of tubes 4.0" outside diameter reduced from 5.25" outside diameter.
Figure 6:
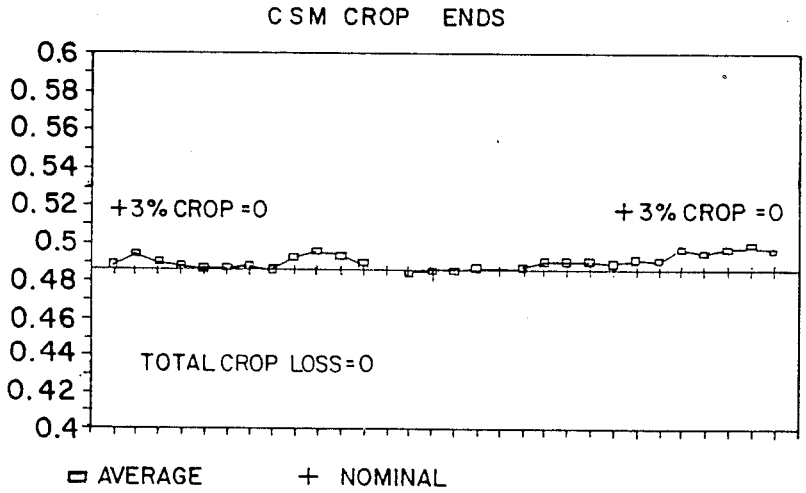
Figure 7:
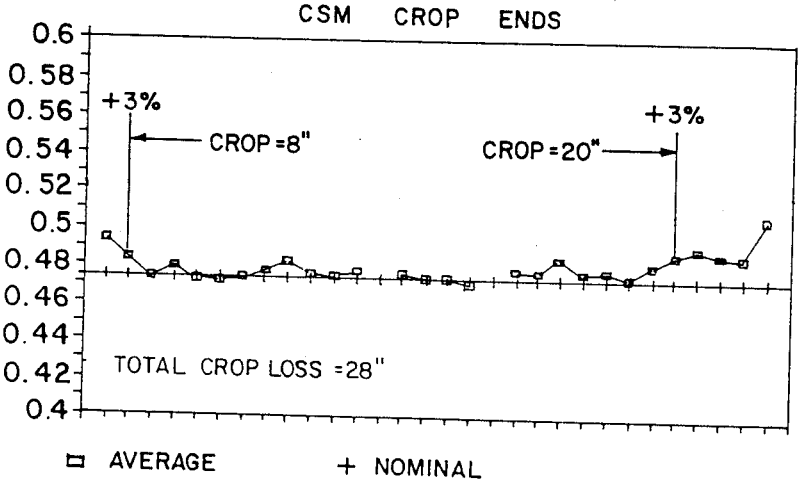
Figure 8:
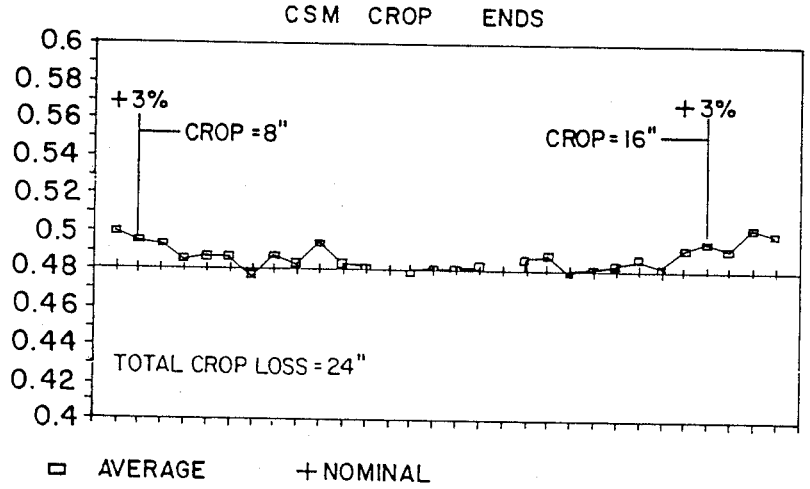
Figure 9:
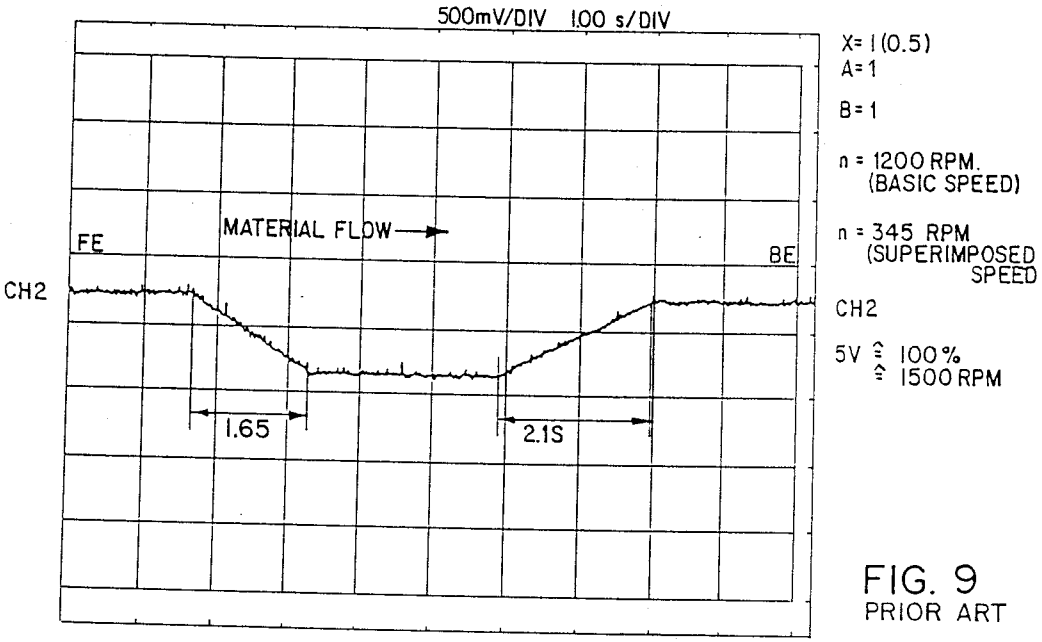
FIG. 9 PRIOR ART
FIG. 9 is a graph showing the various drive motor speeds supplied on the original equipment as the tube or pipe enters the mill, when the main portion of length is being rolled and as the tube or pipe leaves the mill.

It is known in the art that pure reducing over a total length of tube or pipe will produce a tube (or pipe) with heavier wall thickness in the main central portion or body of the tube and lighter wall thickness in the end sections (both front and back ends), together with distorted inside diameter shape due to non-uniform radial stresses acting on the tube section. For that reason, the pure reducing process has according to the prior art been replaced by the stretch reducing process (the tube being in tension between successive roll stands) when fairly large diameter reductions are required because stretch reducing offers better control of inside diameter shape. However, reducing with tension between stands causes the tube end sections to be heavier in thickness than the main central portion of the tube, due to the fact that a stable stress condition is not achieved in the tube length until it is acted upon by all stands of the reducing mill, resulting in loss of material yield due to these end sections being heavier than maximum wall thickness permitted by the various tube and pipe specifications. Efforts prior to my invention to reduce these crop end losses have produced various forms of "crop end control" systems, each of which attempts to build up tensile forces in the tube end sections more quickly by providing increased speed differentials between the rolling stands as the tube ends enter and leave the mill, and reverting to stabilized speed differentials for rolling of the main portion of the tube or pipe length. FIG. 9 shows motor speed characteristics for such a crop end control system supplied as original equipment for the reducing mill on which rolling trials were conducted to develop the control system which is the subject of this patent application. FIG. 9 shows increased drive motor speed as the tube front end enters the mill and as the back end leaves the mill, with lower, normal overspeed acting on the tube or pipe as the main portion of length is being rolled. FIGS. 3, 4, 7 and 8 show results of tubes processed with the originally supplied, conventional type of crop end control.

Figure 10:
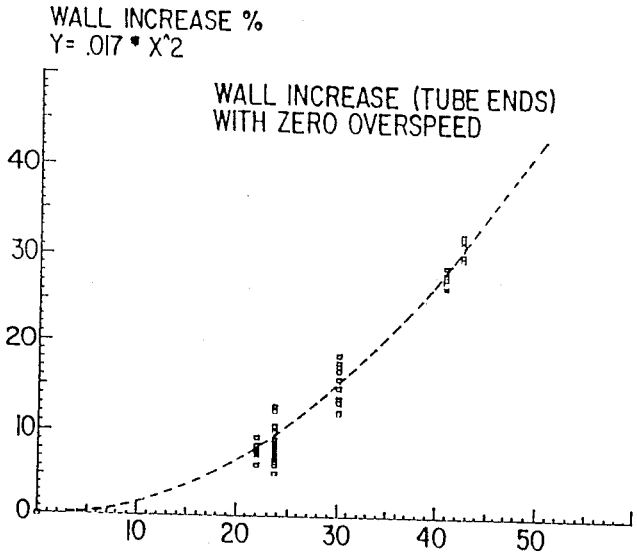
FIG. 10 is a graph showing a mathematical curve which was developed from data obtained by actual trial rollings relating wall thickness increase to tube diameter reduction.
Figure 11:
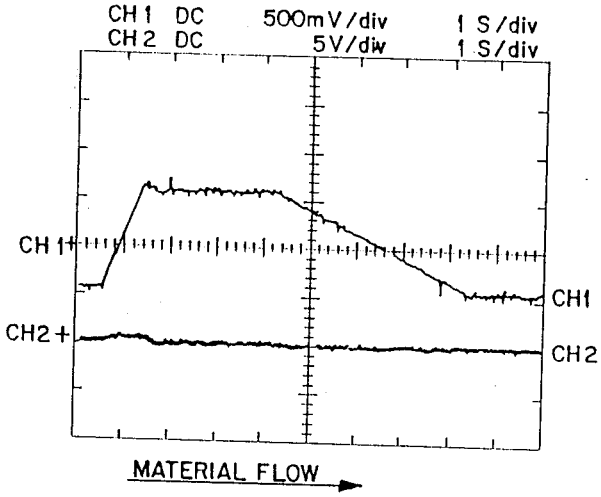
FIG. 11 is a typical motor speed graph illustrating the differing rates of acceleration as the different portions of the tube or pipes are being rolled.

To combine the two processes of pure reducing and stretch reducing according to my invention, it is necessary to know the amount by which the wall thickness at the tube or pipe ends will increase without interstand tension. FIG. 10 depicts a mathematical curve relating wall thickness increase to tube or pipe diameter reduction which was developed from data obtained by actual trial rollings. With this information, the wall thickness necessary to be supplied to the reducing mill to provide the desired wall thickness after reducing can be calculated. With formulae developed from further rolling trials, relating interstand tension to amount of wall thickness increase, the amount of differential speed increase in successive rolling stands, or "overspeed" necessary to restrict wall thickness increase in the tube or pipe body, or main portion of length, to an amount equal to that of the thickness increase of the ends, can be calculated. It then remains only to provide a speed control system, which is essentially opposite that normally supplied with conventional crop end control systems, which allows the tube or pipe ends to be rolled at zero overspeed and increasing to an overspeed for rolling of the tube body which will maintain wall thickness uniformity from end to end of the tube. The control must provide variable overspeeds and variable rates of acceleration from zero overspeed to controlled overspeed to accommodate the variety of tube sizes to be produced. FIG. 11 depicts a typical motor speed chart illustrating tube ends being rolled at reduced or zero overspeed with the main portion of tube or pipe length being rolled at increased overspeed. The differing rates of acceleration to overspeed from the front end and from overspeed to the back end are necessary to control the differing effects of interstand tensions on the front and back ends of the tube or pipe. FIGS. 1, 2, 5 and 6 illustrate the wall thickness uniformity produced using my inventive method of crop end control.

FIGS. 12 through 14 are plots of average wall thickness along the length of sample tubes showing thicknesses at four inch increments from the front and back ends and the center portion of the tube length. The three tubes to which FIGS. 12 to 14 relate were of approximately the same wall thickness and were subjected to approximately the same amount of outside diameter reduction but were produced by three different methods. The tube of FIG. 12 was rolled without crop end control, therefore the overspeed was constant throughout the length of the tube. At a maximum wall thickness tolerance of 3% (for example purposes) a total crop end loss of 76 inches is indicated. The tube of FIG. 13 was produced using overspeed and crop end control as supplied by the original equipment manufacturer. The crop end loss has been considerably reduced to a total of 28 inches but as FIG. 14 shows, for the tube reduced according to my method of overspeed and crop end control, the total crop loss has been reduced to zero.

Formulae have been developed to calculate the wall thickness necessary on entering the stretch reducing mill to produce the desired finished wall thickness and the overspeed necessary to restrict wall thickness increase in the tube or pipe body to produce the same desired finished wall thickness throughout the tube or pipe length. The increase of wall thickness in the tube end sections is according to FIG. 10 and is calculated in the following manner—

Let $D_i$=initial or entering tube or pipe diameter $D_f$=finished tube or pipe diameter $t_f$=finished wall thickness desired $t_i$=initial or entering wall thickness Then x=outside diameter reduction (%)

$$\frac{100\,(D_i - D_f)}{D_i}$$

y=wall thickness increase % (ends)=0.017 $x^2$ for $t_f$=finished wall thickness (ends) =

$$t_i\left(1 + \frac{y}{100}\right)$$

Then $$t_i = \frac{t_f}{1 + \frac{y}{100}}$$

The amount of overspeed required to control the wall thickness increase within the main length or body of the tube to the same wall thickness as the tube ends is dependent upon a variety of factors, some of which are controlled by the physical design of the stretch reducing mill. Among these factors are the center-to-center distance between successive roll stands, diameter of rolls, the number of active roll stands in use to provide a given overall reduction of tube diameter, the rate of diameter reduction per stand and the rate of speed change between successive stands of the basic speed curve, not including overspeed. Since these design elements vary from one stretch reducing mill to another, the crop end control system must be customized to each individual mill.

The design of the crop end control system takes into account these physical mill design factors plus the overall diameter reduction to be performed, the length of tube ends which should be allowed to increase freely without tension before tension is applied and subsequently reduced through the use of overspeed, and the rate of acceleration to overspeed and from overspeed to maintain wall thickness uniformity in the transition lengths between ends and body of the tube and the differing effects of stretch reducing on the front and back end length portions. With these factors considered, the proper amount of overspeed to produce uniformity of wall thickness throughout the tube length is calculated.

A typical calculation for the overspeed required to match wall thickness of the tube body to wall thickness of the end portions of length is as follows—

Let

L=length of tube end to be reduced without tension cc=center-to-center spacing between successive roll stands c=roll stand position to begin acceleration to overspeed e=roll stand position of last reduction pass Then c=L/cc and wall thickness of the tube end sections at locations c and e will be—

$$t_c = t_i\left(1 + \frac{y_c}{100}\right) \text{and } t_e = t_i\left(1 + \frac{y_e}{100}\right)$$

The wall thickness increase of the tube body must then be restricted to this same wall thickness increase of the end sections by developing interstand tension through the use of overspeed.

Elongation of the tube or pipe between roll stands c and e will be—

$$E = \frac{t_c}{t_e} \times \frac{D_c - t_c}{D_e - t_e}$$

where $D_c$=pass diameter of stand c

De=pass diameter of stand e

The ratio of pitch line diameters between stands c and e is—

$$R = \frac{10.63 - .87 \times D_c}{10.63 - .87 \times D_e}$$

where 10.63=roll diameter of mill on which trials were made

The ratio of overspeed=$N_o$ to base speed=$N_b$ can now be calculated. A typical formula for the particular reducing mill on which trials were made is—

$$\frac{N_o}{N_b} = \left(1 - \frac{1}{E \times R}\right) \times \frac{Z_c}{9.474}$$

where $Z_c$=overspeed gear ratio at stand c 9.474=factor related to basic mill gearing A comparative example of the stretch reducing mill setups by the two methods, each of which is designed to produce the same finished tube size of 2.0" diameter×0.288" wall thickness is—

As a stretch reducing mill with crop end control—entering shell outside diameter $D_i$=3.5"

wall thickness $t_i$=0.264"

base motor speed=1200 rpm overspeed motor speed=581 rpm

As a combination of pure reducing for end sections with stretch reducing for tube body portion of length—entering shell outside diameter $D_i$=3.5"

wall thickness $t_i$=0.223"

base motor speed=1200 rpm overspeed motor speed=307 rpm

What is claimed is:

1. A method of reducing tubular metal products comprising the steps of:

(a) selecting a tubular member to be reduced having an initial wall thickness necessary to produce the desired finished wall thickness;

(b) processing said member through a reducing mill having successive rotating roll stands of decreasing roll groove diameters, the rotation speed differential between successive roll stands being variable;

(c) varying the roll rotation speed differential between successive roll stands as processing progresses to apply substantially no longitudinal tension to the tubular member as the front end portion enters and as the rear end portion leaves the roll stands, and to apply sufficient tension as the portion of the tube member intermediate the end portions is processed to restrict wall thickness increase in the intermediate portion to the same amount produced in the end portions.

2. The method of claim 1 wherein the tubular member to be reduced is selected having an initial wall thickness of $t_i$ where $$t_i = \frac{t_f}{1 + \frac{y}{100}}$$

$t_f$=finished wall thickness desired (ends)

$$= t_i\left(1 + \frac{y}{100}\right)$$

$D_i$=initial or entering tube or pipe diameter $D_f$=finished tube or pipe diameter x=outside diameter reduction (%)

$$= \frac{100\,(D_i - D_f)}{D_i}$$

and y=wall thickness increase % (ends) $=0.017x^2$.

3. The method of claim 1 wherein the tubular product is reduced to a uniform wall thickness having zero crop end loss.

4. The method of claim 1 wherein the tubular metal product is steel tube.

5. A method of rolling speed control of a stretch reducing mill for hot reducing of the diameter of tubular members of ferrous or non-ferrous material wherein the roll rotation speed differential between successive roll stands is varied as rolling progresses to roll the tubular member substantially without longitudinal tension as the front end portion enters and as the rear end portion leaves the roll stands, and with sufficient tension as the portion of the tube member intermediate the end portions is rolled to restrict wall thickness increase in the intermediate portion to the same amount produced in the end portions.

* * * * *